US006230693B1

(12) United States Patent
Meiller et al.

(10) Patent No.: US 6,230,693 B1
(45) Date of Patent: May 15, 2001

(54) EVAPORATIVE EMISSION CANISTER WITH HEATED ADSORBER

(75) Inventors: Thomas Charles Meiller, Pittsford; Charles Henry Covert, Manchester; Susan Scott Labine, Avon; Richard William Wagner, Albion, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/520,422

(22) Filed: Mar. 8, 2000

(51) Int. Cl.[7] ..... F02M 37/04
(52) U.S. Cl. ..... 123/519; 123/520; 123/557
(58) Field of Search ..... 123/516, 518, 123/519, 520, 557

(56) References Cited

U.S. PATENT DOCUMENTS

| | | | | |
|---|---|---|---|---|
| 5,191,870 | | 3/1993 | Cook . | |
| 5,235,955 | | 8/1993 | Osaki . | |
| 5,289,811 | | 3/1994 | Covert et al. . | |
| 5,317,909 | | 6/1994 | Yamada et al. . | |
| 5,355,861 | * | 10/1994 | Arai | 123/519 |
| 5,357,934 | | 10/1994 | Iida et al. . | |
| 5,377,644 | * | 1/1995 | Krohm | 123/520 |
| 5,437,257 | | 8/1995 | Giacomazzi et al. . | |
| 5,456,236 | * | 10/1995 | Wakashiro | 123/519 |
| 5,687,697 | * | 11/1997 | Ishkawa | 123/520 |
| 6,098,601 | * | 8/2000 | Reddy | 123/520 |

* cited by examiner

*Primary Examiner*—Thomas N. Moulis
(74) *Attorney, Agent, or Firm*—Vincent A. Cichosz

(57) ABSTRACT

An auxiliary canister operates with a storage canister of an evaporative emissions control system to reduce the amount of fuel vapor emitted from a vehicle to very low levels. The storage canister contains a first sorbent material and has a vent port in communication therewith. The auxiliary canister comprises an enclosure, first and second passages, a heater and a connector. Inside the enclosure, a second sorbent material is in thermal contact with the heater. Attached at one end to the bottom of the enclosure, the first passage is connectable at its other end to the vent port to allow flow between the storage and auxiliary canisters. Attached at one end to a top of the enclosure, the second passage is connectable at its other end to a vent valve of the control system to allow flow between the auxiliary canister and the vent valve. Incorporated into the enclosure, the connector is used to convey electrical power from the vehicle to the heater. During a regenerative phase of operation for the control system, the heater can be used to heat the second sorbent material and the passing purge air. This enables the second and first adsorbent materials to more readily release the fuel vapor they adsorbed during the previous storage phase of operation so that they can be burned during combustion.

34 Claims, 8 Drawing Sheets

EVAPORATIVE EMISSION CANISTER WITH HEATED ADSORBER

FIELD OF THE INVENTION

The present invention relates, in general, to the reduction of evaporative emissions from motor vehicles. More specifically, the invention relates to an evaporative emission control system employing a heated adsorber.

BACKGROUND OF THE INVENTION

Evaporative emissions of fuel vapor from a vehicle having an internal combustion engine occur principally due to venting of the fuel tank of the vehicle. When the vehicle is parked, diurnal changes in temperature or pressure of the ambient atmosphere cause air to waft into and out of the fuel tank. Some of the fuel inevitably evaporates into the air within the tank and thus takes the form of a vapor. If the air emitted from the fuel tank were allowed to flow untreated into the atmosphere, it would inevitably carry with it this fuel vapor. The fuel vapor, however, is a pollutant. For that reason, federal and state governments have imposed increasingly strict regulations over the years governing how much fuel vapor may be emitted from the fuel system of a vehicle.

One approach that automobile manufacturers have long employed to reduce the amount of fuel vapor that a vehicle emits to the atmosphere involves the use of a storage canister. In this approach, a tube, often referred to as a "tank tube," is used to connect the air space in the fuel tank to the storage canister. Inside the storage canister is contained a sorbent material, typically activated carbon, whose properties enable it to adsorb the fuel vapor. Consequently, when air flows out of the tank, the tank tube carries it to the storage canister wherein the fuel vapor is adsorbed into the sorbent material There the fuel vapors are temporarily stored so that they can be burned later in the engine rather than being vented to the atmosphere when the engine is not operating.

FIGS. 1 and 2 illustrate one type of storage canister, generally designated 10, typically used in the automotive industry. FIG. 1 shows the canister in a perspective view, whereas FIG. 2 shows it in cross-section. The storage canister 10 comprises a container 18 that is partially divided by partition 24 into two compartments 20 and 22. An intercompartmental flow passage 26 connects these compartments.

The storage canister 10 has a tank port 12 and a purge port 14, both of which communicate with the first compartment 20. The tank port 12 connects to the tank tube 7, and thereby allows the air space in the fuel tank 8 to communicate with the first compartment 20. To the left of the tank port 12 as viewed from the perspective of FIG. 2, the purge port 14 connects to a purge line 19. Through a purge valve 15, the purge line 19 connects to the air intake passage 9 of the vehicle 11. (Air flowing into the air intake passage 9 is mixed with fuel, and the mixture eventually drawn into the cylinders for combustion.) The purge valve 15 is closed when the engine is not running. When the engine is running, however, purge valve 15 is opened in and thereby allows the storage canister 10 via the first compartment 20 to communicate with the air intake 9.

The storage canister 10 also features a vent port 16 that communicates with the second compartment 22. The vent port 16 connects to a vent line 6. The vent line 6 communicates with the ambient atmosphere through a vent valve 17. Typically controlled via a solenoid, the vent valve 17 is normally held open. When opened, the vent valve 17 allows the storage canister 10 via the second compartment 22, vent port 16 and vent line 6 to communicate with the atmosphere. The vent valve 17 is closed when the storage canister 10 is being tested for leaks.

Evaporative emission control systems of this type essentially have two phases of operation. During the storage phase when the engine is off, the system operates with the purge valve 15 closed and the vent valve 17 opened. When the pressure in the fuel tank 8 is high relative to atmospheric pressure, air from the tank and the fuel vapor it carries flows into tank tube 7 and through tank port 12 into storage canister 10. Inside the storage canister 10, the fuel vapor is adsorbed by the sorbent material 28 as the air that carried it flows not only through the first compartment 20 but also through the second compartment 22 via intercompartmental flow passage 26. Although a high percentage of the fuel vapor is adsorbed into the sorbent material 28, the air as it exits the canister 10 via vent port 16 carries with it some unadsorbed fuel vapor to atmosphere.

During the regenerative phase of operation when the engine 90 is running, the system operates with both the purge valve 15 and the vent valve 17 opened. A vacuum is developed within the intake manifold as a result of the combustion occurring within the cylinders of the engine 90. This vacuum ultimately causes fresh air from the atmosphere to be drawn through vent valve 17 and into the storage canister 10. Specifically, the air is pulled by vacuum through vent port 16, second compartment 22, flow passage 26, first compartment 20 and out purge port 14. Inside the storage canister 10, as the fresh air flows through the sorbent material 28, it strips it of the fuel vapor that it had adsorbed during the previous storage cycle. The sorbent material 28 is thus regenerated for the next storage phase. The purged fuel vapors are carried by the air stream through purge line 19, purge valve 15, air intake passage 9 and to the cylinders where they are consumed as fuel during combustion.

During the storage phase, the fuel vapors previously adsorbed by the sorbent material 28 may also return to the fuel tank 8 when the pressure in the tank lowers relative to atmospheric pressure. This happens when the temperature inside the fuel tank 8 drops and the fuel vapors condense. Being normally open, the vent valve 17 under such conditions allows air into the storage canister 10 and relieves any vacuum.

Due to the increasingly stringent air quality standards, the automotive industry has pondered several ways of further reducing the emissions of evaporated fuel. Thought has been given to increasing the size or number of compartments in the storage canister 10. Those approaches have been deemed undesirable due to excessive cost and bulk. Various proposals for heating the storage canister 10 electrically have also been considered. Those approaches have also proved undesirable due to the electrical power they would require.

OBJECTIVES OF THE INVENTION

It is therefore an objective of the invention to reduce emissions of evaporated fuel from a motor vehicle to levels lower than previously achievable.

Another objective is to provide an evaporative emission control system having improved diurnal performance.

Still another objective is to capture minute breakthrough emissions from an evaporative emission control system.

A further objective is to enable the use of modern internal combustion engine fuels having increased volatility without increasing evaporative emissions.

An additional objective is to provide heat to assist the endothermic desorption process in an evaporative emission control system.

Yet another objective is to desorb adsorbed water from high retentivity carbon in an evaporative emission control system.

Yet another objective is to provide an evaporative emission control system for a motor vehicle having a superabsorber that is protected from contamination during fueling.

An additional objective is to provide an evaporative emission control system that employs heat to assist desorption of vapor and which minimizes electrical heating requirements.

Another objective is to provide an evaporative emission control system that reduces emissions to ultra-low levels, and one that is rugged and easy to maintain.

A further objective is to reduce the amount of partitioning needed in storage canisters used in such evaporative emission control systems.

Yet a further objective is to reduce the size of storage canisters used in such evaporative emission control systems.

An additional objective is to reduce the volume of purge air required in such evaporative emission control system.

Another objective is to achieve ultra-low evaporative emission levels while reducing the need to use fuel having low values of REID vapor pressure.

A further objective of the invention is to provide a refueling bypass to reduce air pressure in the fuel tank during refueling to prevent shutoff of the refueling nozzle.

An additional objective of the invention is to reduce contamination of the auxiliary canister by refueling vent flow.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the drawings and claims presented herein.

SUMMARY OF THE INVENTION

The foregoing objectives and advantages are attained by an evaporative emissions control system that reduces the amount of fuel vapor emitted from a vehicle to very low levels. The vehicle has an engine with an intake passage and a fuel system. According to the invention, the control system comprises a primary canister and an auxiliary canister. The primary canister has a purge port, a tank port and a vent port in communication with a first sorbent material disposed within the primary canister. The purge port communicates with the intake passage via a purge valve. The tank port communicates with the fuel system and allows a mixture of air and the fuel vapor it carries to be conveyed between the fuel system and the primary canister. The auxiliary canister has a first flow passage and a second flow passage in communication with a second sorbent material disposed within the auxiliary canister. The first flow passage connects to the vent port of the primary canister, and the second flow passage connects to one end of a vent valve whose other end communicates to atmosphere. The auxiliary canister has a heater and an electrical connector connected to a source of electrical power onboard the vehicle. During at least one predetermined time interval, electrical power is supplied to the heater to heat the second sorbent material when the control system is operated in a regenerative phase of operation. During a storage phase of operation, the control system allows the mixture of air and fuel vapor to flow from the fuel system through the tank port and into the primary canister. As the mixture flows through the primary canister, the first sorbent material adsorbs a first percentage of the fuel vapor. The mixture of air and any unadsorbed fuel vapor then flows out the vent port and through the first flow passage into the auxiliary canister. As the once filtered mixture flows through the auxiliary canister, the second sorbent material adsorbs a second percentage of the fuel vapor, with the now twice-filtered air flowing out the second flow passage and through the vent valve it to atmosphere. During the regenerative phase, the control system allows air drawn in from atmosphere to flow through the vent valve and second flow passage into the auxiliary canister. As the air flows through the auxiliary canister, fuel vapor is desorbed from the second sorbent material, particularly during the predetermined interval when it is heated. The warmed mixture of air and fuel vapor is then drawn through the first flow passage and vent port into the primary canister. As the mixture flows through the primary canister, fuel vapor is desorbed from the first sorbent material. The mixture is drawn out through the purge port and into the intake passage by and for combustion within the engine of the vehicle.

In a related aspect, the invention provides an auxiliary canister for use with a storage canister of an evaporative emissions control system to aid in reducing the amount of fuel vapor emitted from a vehicle. The storage canister has a vent port in communication with a first sorbent material housed in the storage canister. The auxiliary canister comprises an enclosure, a second sorbent material, first and second flow passages, a heater and an electrical connector. The second sorbent material is disposed within the enclosure and is in thermal contact with the heater. The first flow passage at one end is attached to a bottom of the enclosure. At its other end, the first flow passage is connectable to the vent port so as to allow flow between the storage and auxiliary canisters. Attached at one end to a top of the enclosure, the second flow passage is connectable at its other end to a vent valve of the control system so as to allow flow between the auxiliary canister and the vent valve. Incorporated into the enclosure, the electrical connector is used to convey electrical power from the vehicle to the heater to heat the second adsorbent material.

DETAILED DESCRIPTION OF THE INVENTION

Figure 1:
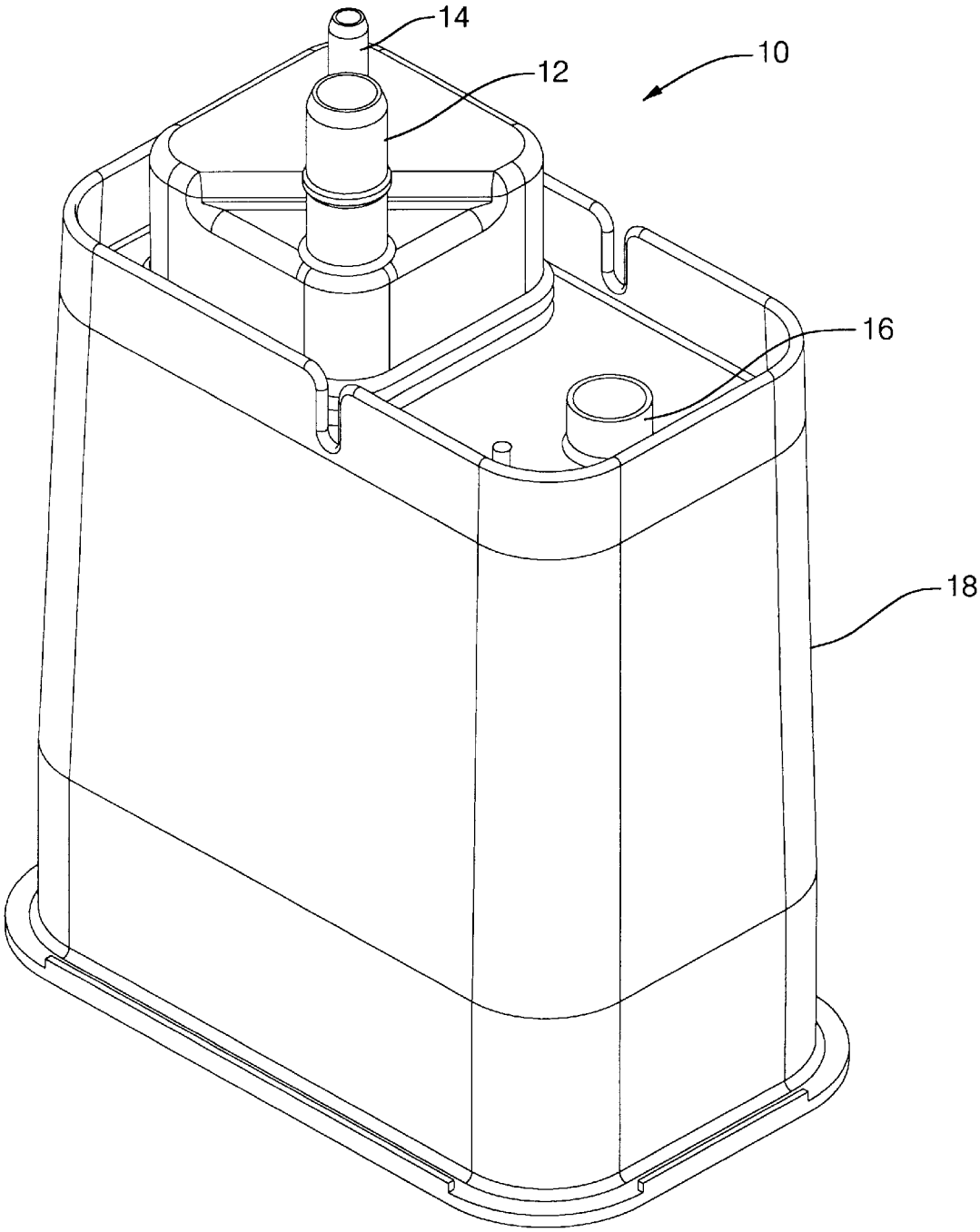
PRIOR ART FIG. 1
FIG. 1 is a perspective view of a prior art storage canister used to reduce emissions of evaporated fuel.

Before describing the invention in detail, the reader is advised that, for the sake of clarity and understanding, identical components having identical functions have been marked where possible with the same reference numerals in each of the Figures provided in this document.

Figure 2:
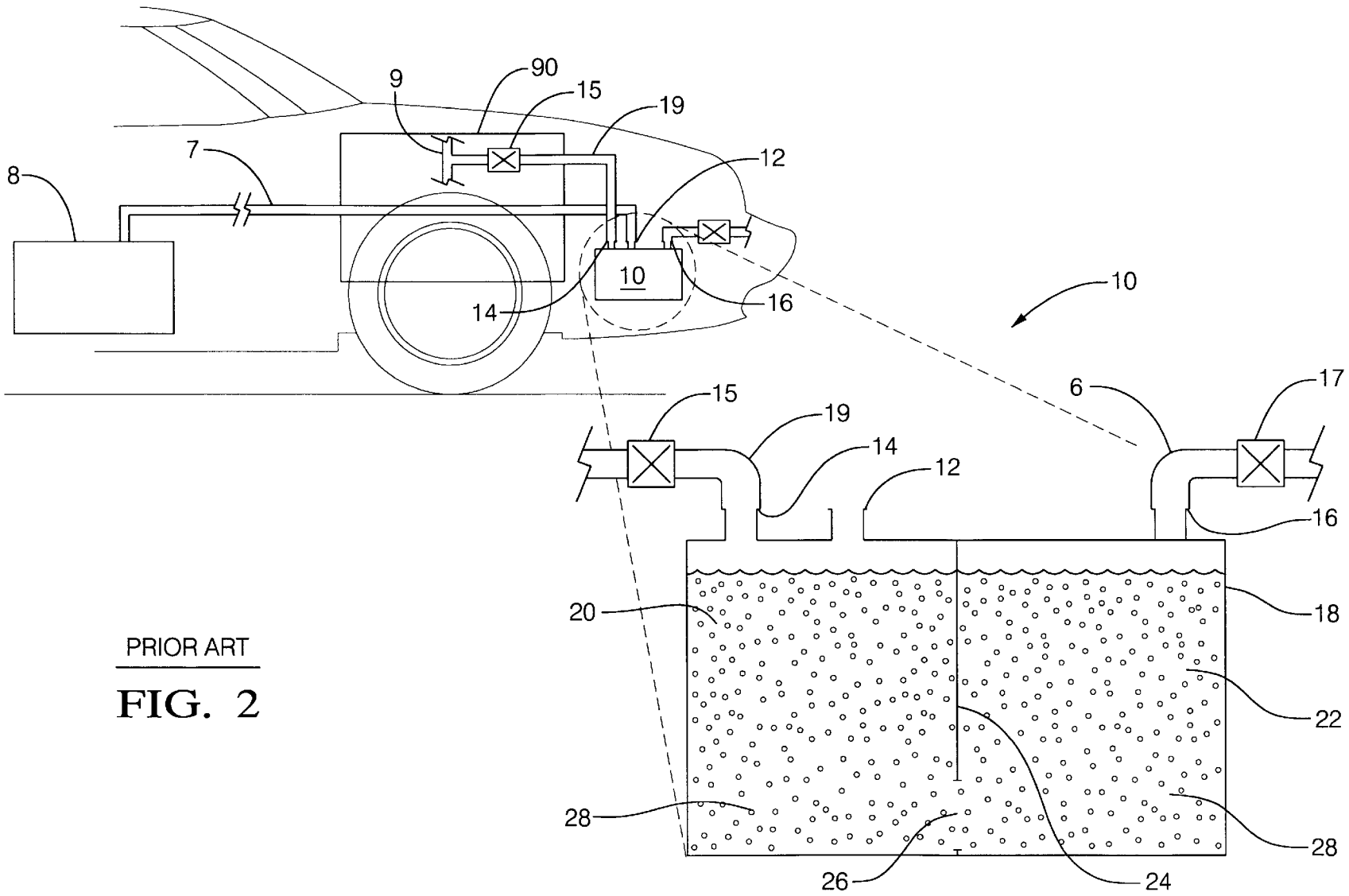
PRIOR ART FIG. 2
FIG. 2 is a schematic cross-sectional view showing the interior of the prior art storage canister shown in FIG. 1.
Figure 3:
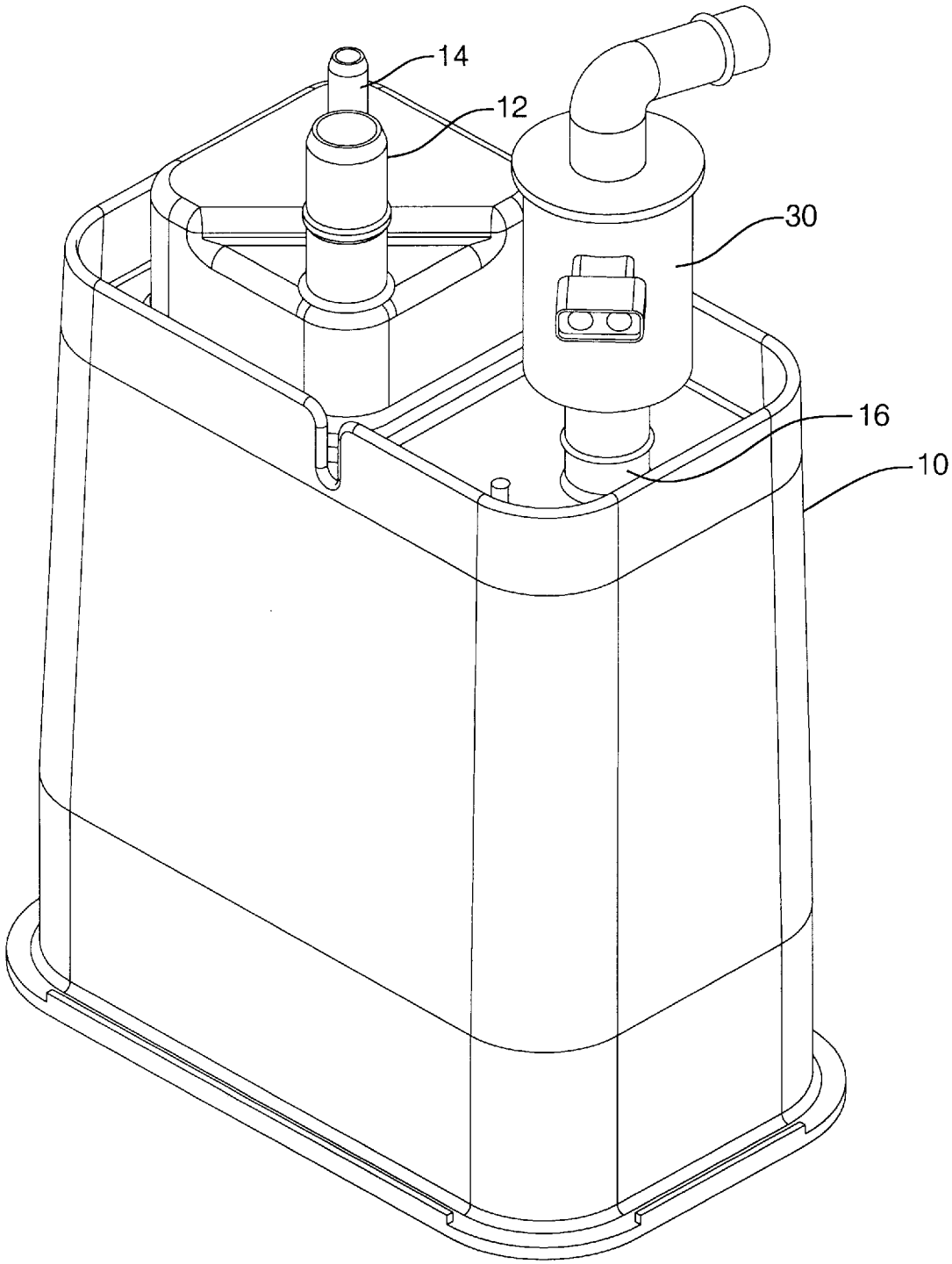
FIG. 3 is a perspective view of the prior art storage canister shown in FIG. 1 deployed with an auxiliary canister according to the invention.
Figure 4:
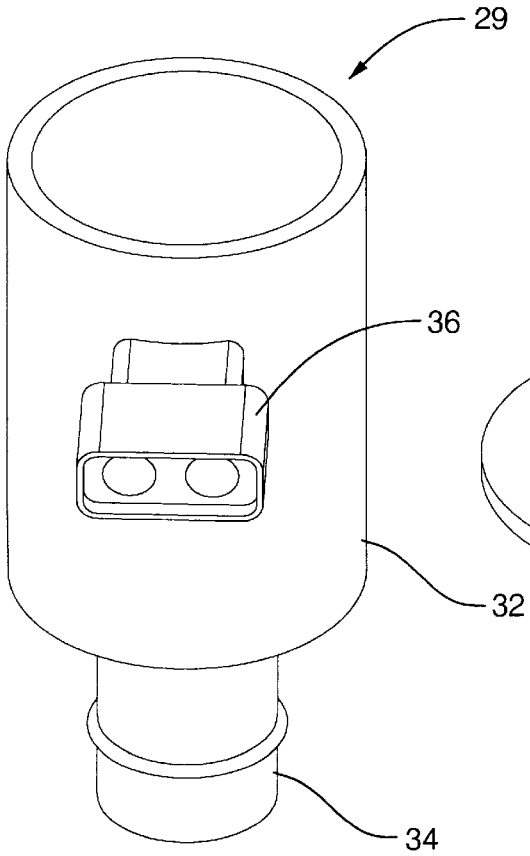
FIG. 4 is a perspective view of the case of the auxiliary canister illustrated in FIG. 3.
Figure 5:
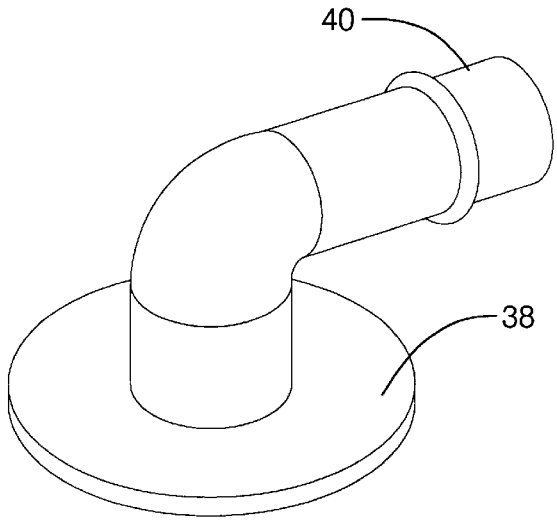
FIG. 5 is a perspective view of a cover and one flow passage of the auxiliary canister shown in FIG. 3.

As noted in the background section of this document, FIGS. 1 and 2 show a prior art storage canister 10 and its various ports. Attention is now directed to FIGS. 3 through 5, which show a presently preferred embodiment of the invention. An auxiliary canister 30 is shown in these figures. The purpose of auxiliary canister 30 is to function in cooperation with the primary storage canister 10 to reduce emissions of fuel vapor to in levels much lower than was possible with the canister 10 alone. The sorbent material contained within the auxiliary canister 30 is heated during at least one time when the engine 90 of vehicle 11 is running, to facilitate purging of sorbed fuel vapors.

The auxiliary canister 30 has an enclosure 29 inclusive of a case 32 and a lid 38. Viewed from the perspective of FIG. 4, case 32 has a first flow passage 34 attached to its bottom and an electrical connector 36 incorporated within its side. The first flow passage 34 is designed to attach to vent port 16 of storage canister 10, as shown in FIG. 3. The electrical connector 36 is connected to a heater located inside the case 32. As described further below, electrical power is conveyed from the vehicle to the heater through this electrical connector 36. The lid 38 affixes atop case 32. Projecting from the top of lid 38 is a second flow passage 40, as shown in FIG. 5.

Figure 6:
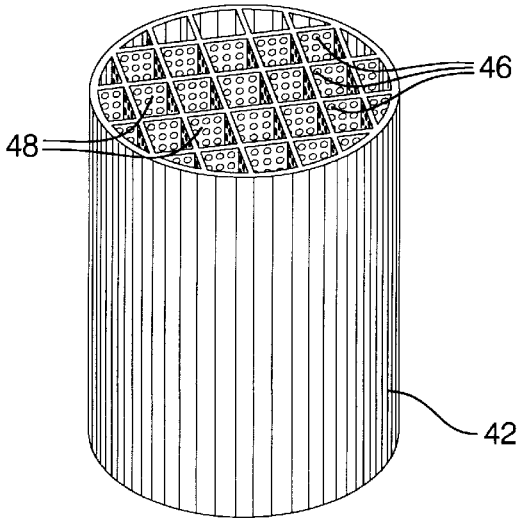
FIG. 6 is a perspective view of a preferred embodiment of a heater for the auxiliary canister.

FIGS. 6 through 9 show alternative designs for the heater and sorbent material to be used within the auxiliary canister 30. FIG. 6 shows the presently preferred embodiment, which is a honeycomb heater 42 having surfaces 48 and a layer of sorbent material 46 on surfaces 48. Preferably, the heater 42 is an electrically conducting ceramic and the sorbent material 46 is an activated carbon. Persons skilled in the automotive engine arts will recognize that heater 42 may be made by technology available in positive temperature control devices. Preferably, sorbent material 46 consists of granules of activated carbon cemented to surfaces 48 by an acrylic cement.

The sorbent material 46 may be standard automotive carbon. Preferably, however, the sorbent material 46 has a higher surface (i.e., a greater surface area per unit mass) and lower density than standard automotive carbon. Sorbent material 46 may, for example, be the type of activated carbon that is usually employed in gas masks. Because the density of the sorbent material is low, its thermal conductivity is also low. The design of the heater 42 places the sorbent material 46 in direct thermal contact with surfaces 48 to ensure heating of the sorbent material 46.

Figure 7:
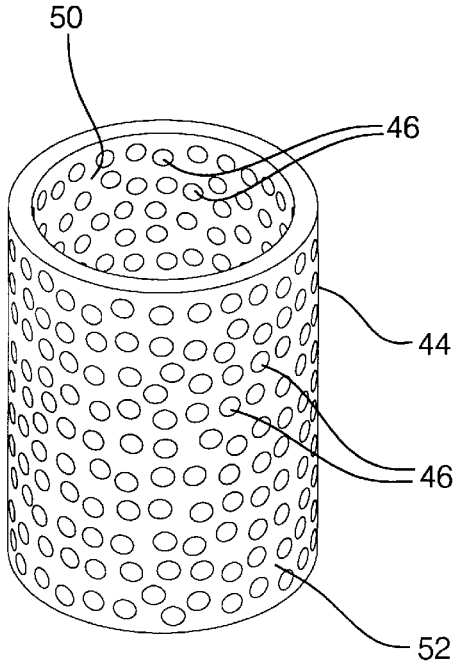
FIG. 7 is a perspective view of an alternative embodiment of a heater for the auxiliary canister.

FIG. 7 shows an alternative design for the heater, one employing a cylindrical shape. The cylindrical heater 44 has an inner surface 50 and an outer surface 52. Sorbent material 46 is placed on one or both of the surfaces 50 and 52. This design places sorbent material 46 in direct thermal contact with one or both surfaces 50 and 52. The cylindrical heater 44 itself is preferably composed of an electrically conducting ceramic.

Figure 8:
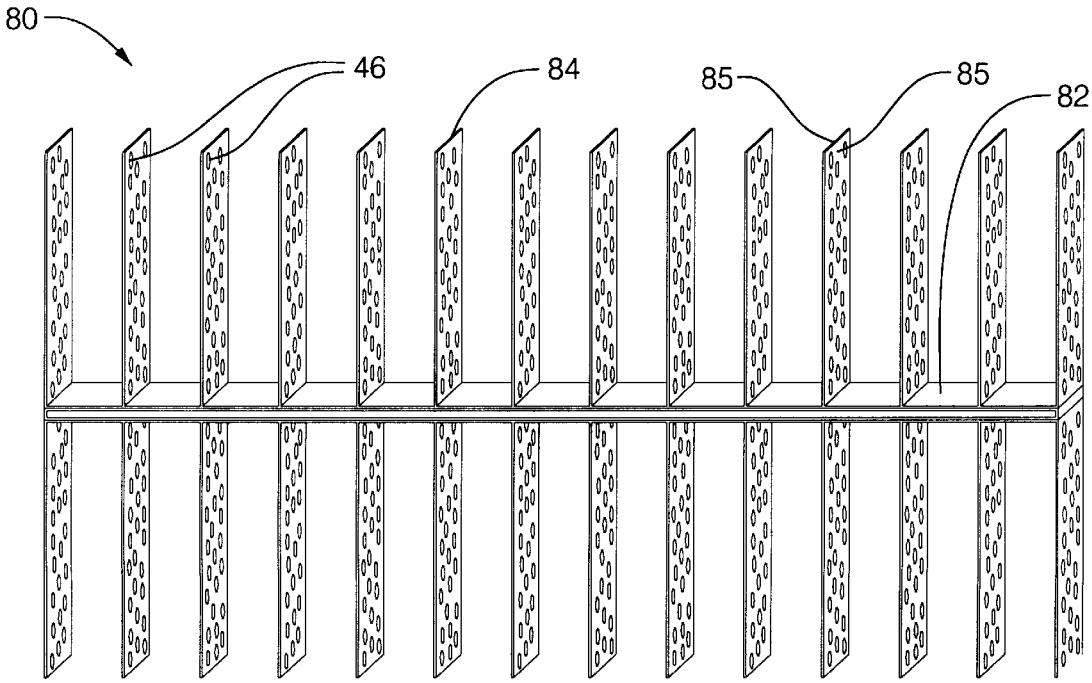
FIG. 8 is a view of another embodiment of a heater for the auxiliary canister.

FIG. 8 depicts another design for the heater, one having a planar portion 82 from which one or more fin(s) 84 project. The planar portion 82 is preferably an electrical resistor. From the resistor 82 projects at least one fin 84 having sorbent material 46 adhered to one or both of its surfaces 85. The fin(s) 84 of this planar heater 80 are preferably made of a high conductivity material, such as aluminum.

Figure 9:
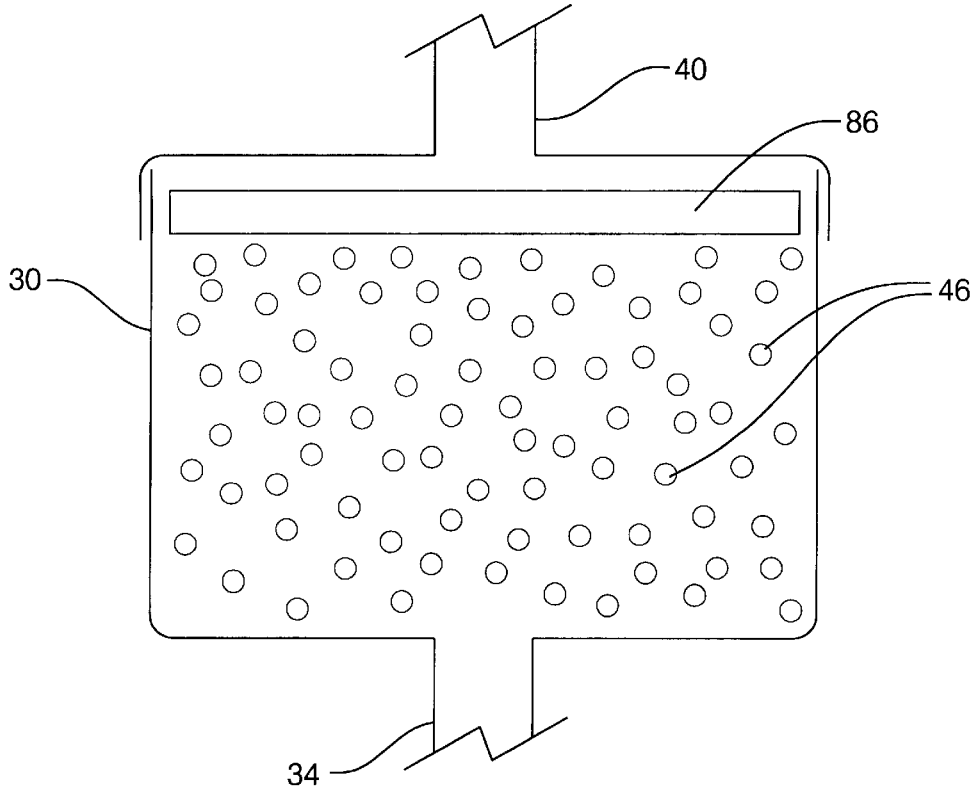
FIG. 9 is a cross-sectional view of an additional embodiment of a heater within the auxiliary canister.

FIG. 9 shows yet another heater design, one that employs convection to carry heat from the heater 86 to the sorbent material 46. Again, the sorbent material 46 is preferably a low density, high surface activated carbon.

Figure 10:
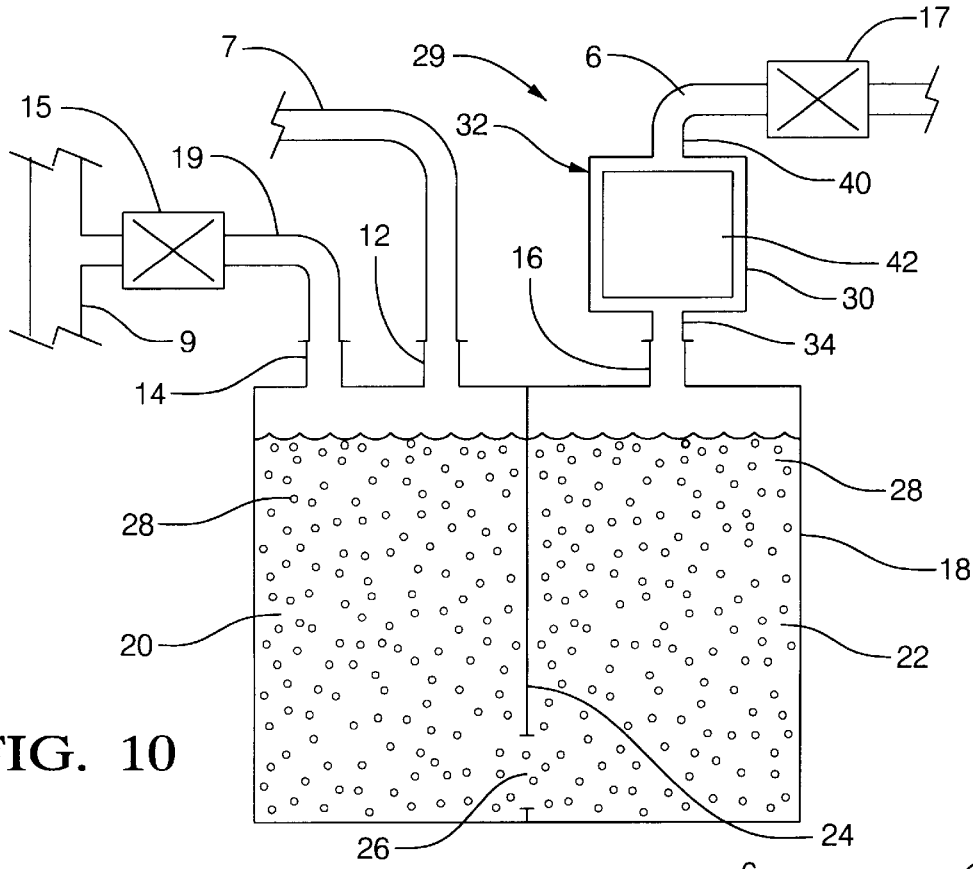
FIG. 10 is a cross-sectional view of an embodiment of the invention showing the auxiliary canister and the prior art storage canister deployed as shown in FIG. 3.

FIG. 10 illustrates a cross-sectional view of the preferred embodiment of the invention showing how the auxiliary canister 30 and the prior art storage canister 10 are deployed together. Although heater 42 is depicted, it should be apparent that any of the others heaters described above may take its place. During the storage phase when the engine 90 is off, the system operates with the purge valve 15 closed and the vent valve 17 opened. When the pressure in the fuel tank 8 is high relative to atmospheric pressure, air from the tank and the fuel vapor it carries flows into the tank tube 7 and through tank port 12 into storage canister 10. Inside the storage canister 10, the fuel vapor is adsorbed (as described above) as the mixture of fuel vapor and air flows through the sorbent material 46. Although the storage canister 10 adsorbs a high percentage of the fuel vapor, the air stream still carries some fuel vapor as it passes from vent port 16 into the auxiliary canister 30 via first flow passage 34. The sorbent material 46 in case 32 of the auxiliary canister 30 extracts even more fuel vapor, as the air passes through the enclosure 29 out second flow passage 40 through vent valve 17 to atmosphere.

During the regenerative phase of operation when the engine 90 is running, the vacuum developed by the engine draws in air from the vent valve 17 through vent line 6 and second flow passage 40 into the auxiliary canister 30. Before this "purge air" is pulled into the vent port 16 of storage canister 10, it passes through the case 32 of the auxiliary canister 30. There it flows through whichever one of the heaters 42, 44, 80 or 86 is deployed in case 32. The heater is preferably activated only during one or more predetermined time intervals when the engine is running. The engine control module (ECM) or other control component (not shown) in the vehicle 11 may be used to define or otherwise control the time interval during which power is supplied to the heater. Selecting an interval that encompasses the period of time soon after the engine is first started is just one option. During the selected interval, electrical power is supplied to the heater 86 via electrical connector 36. The resulting heat is carried to the sorbent material 46, further enhancing its ability to give up the fuel vapors it previously adsorbed. As the air passes over the sorbent material 46, it carries with it the evaporated fuel. Some of the heat generated by the heater is also imparted to the passing air stream.

The vacuum drives the air and fuel vapor it collected from the auxiliary canister 30 through first flow passage 34 into the storage canister 10 via vent port 16. The warmed purge air continues through second compartment 22, flow passage 26, first compartment 20 and out purge port 14. Inside the storage canister 10, the warmth of the passing purge air enables the sorbent material 28 to give up its fuel vapors more readily. Stripped of the fuel vapor that it had adsorbed during the previous storage cycle, the sorbent material 28 is thus regenerated for the next storage phase. The purged fuel vapors are carried by the air stream through purge line 19, purge valve 15, air intake passage 9 and ultimately to the cylinders where they are consumed as fuel during combustion.

Deployed together, the auxiliary canister 30 and the prior art storage canister 10 may be viewed as essentially two containment portions 18 and 29. As shown in perspective in FIG. 3 and in cross-section in FIGS. 10–15, the two containment portions 18 and 29 are interconnected by vent port 16 and first flow passage 34. As is apparent from the foregoing paragraphs, the auxiliary canister 30 operates in such a way as to improve the efficiency of the storage canister 10 with which it is used. Moreover, it also reduces evaporative emissions by itself through its heater and sorbent material 46. The improvement in the operation of the storage canister 10 is due mostly to the heated purge air that the auxiliary canister 30 passes to the sorbent material 28 during the regenerative phase of operation. Together, the two canisters 10 and 30 further reduce the amount of fuel vapor that a vehicle emits to the atmosphere, as compared to prior art approaches.

To reduce power requirements, it is preferred that the mass of the sorbent material 46 in auxiliary canister 30 be substantially smaller than the mass of sorbent material 28 in storage canister 10. Preferably, the mass of sorbent material 46 is less than one tenth of the mass of sorbent material 28. For the embodiments shown in FIGS. 6–8 in which the sorbent material 46 is a thin layer on surfaces 48, 50, 52 or 85, the mass of sorbent material 46 may be less than one percent of the mass of sorbent material 28.

Figure 11:
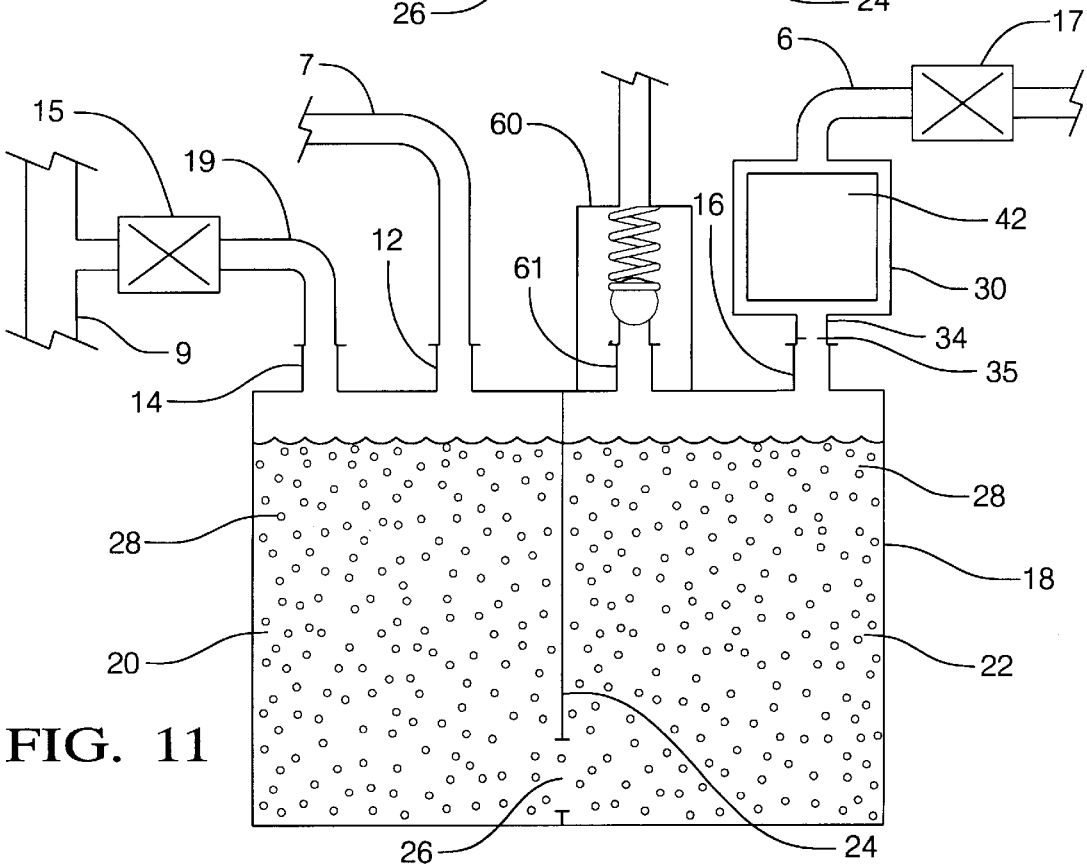
FIG. 11 is a cross-sectional view of another embodiment of the invention illustrating a refuel-bypass valve deployed as a bypass to protect the sorbent material in the auxiliary canister from contamination during refueling.

FIG. 11 shows a refuel-bypass valve 60 added to the embodiment of the invention shown in FIG. 10. The storage canister 10 of FIG. 10 is also modified to include a first bypass port 61. Preferably, a flow restrictor 35, such as an orifice, is provided within either the first flow passage 34 of canister 30 or the vent port 16 of canister 10. The bypass port 61 communicates with the second compartment 22 preferably to the left of vent port 16, as viewed from the perspective of FIG. 11. The bypass valve 60 is connected at one end to the bypass port 61, and its other end is open to atmosphere. Deployed as shown, the bypass valve 60 should be normally closed, opening only when a slight positive pressure exists within the second compartment 22 of storage canister 10.

During refueling of a fuel tank, pressure in the fuel tank rises. As the pressure rises, air from the tank carries fuel vapor into tank tube 7 and through tank port 12 into the storage canister 10. As soon as the pressure in the second compartment 22 rises above a set threshold relative to atmospheric pressure, the bypass valve 60 opens. As long as it stays open, the bypass valve 60 and port 61 allow the air and the unadsorbed fuel vapor to flow from the second compartment 22 to atmosphere, largely bypassing the auxiliary canister 30. Without bypass valve 60, the fuel vapor that is not adsorbed by the sorbent material 28 within canister 10 would flow into the auxiliary canister 30. By permitting some of the unadsorbed evaporate to bypass the auxiliary canister 30, the bypass valve 60 reduces the degree to which the sorbent material 46 in auxiliary canister 30 is contaminated during refueling.

The bypass valve 60 serves an additional purpose. By providing a low impedance path to the atmosphere, the air pressure in the fuel tank during refueling is reduced. This is desirable because air pressure sensed by the refueling nozzle is, in some refueling stations, used to determine that the tank is full. Premature shutoff of the refueling nozzle may occur if air pressure in the fuel tank increases excessively.

Figure 12:
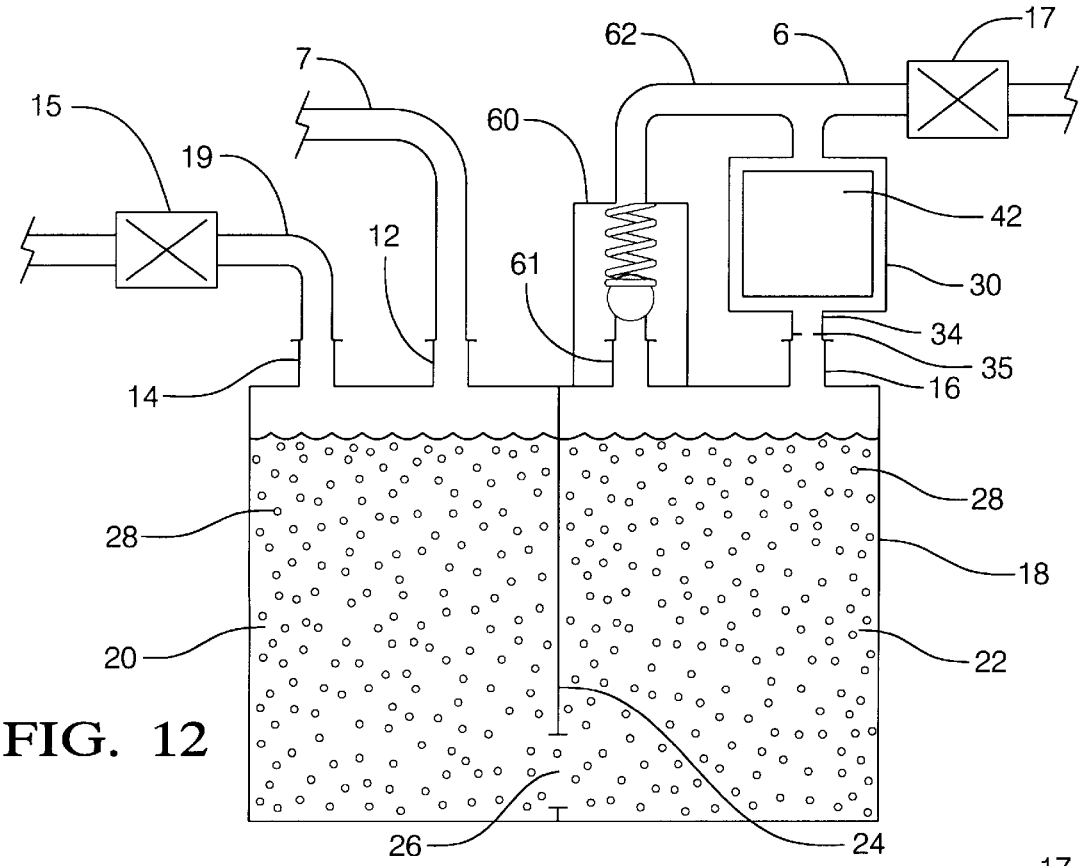
FIG. 12 is a cross-sectional view of another embodiment illustrating the refuel-bypass valve deployed to protect the auxiliary canister during refueling and to simplify testing of the overall system for leaks.

FIG. 12 illustrates a variation on the embodiment shown in FIG. 11. In this case, the bypass valve 60 is connected by bypass passage 62 to the vent line 6 leading to vent valve 17. This arrangement simplifies testing the system for leaks. During a leak test, the purge valve 15 and the vent valve 17 are both closed after a partial vacuum has been applied to the system. By connecting the outlet of the bypass valve 60 to the vent valve 17, the bypass valve 60 cannot leak to atmosphere, as would be the case for the embodiment shown in FIG. 11.

Figure 13:
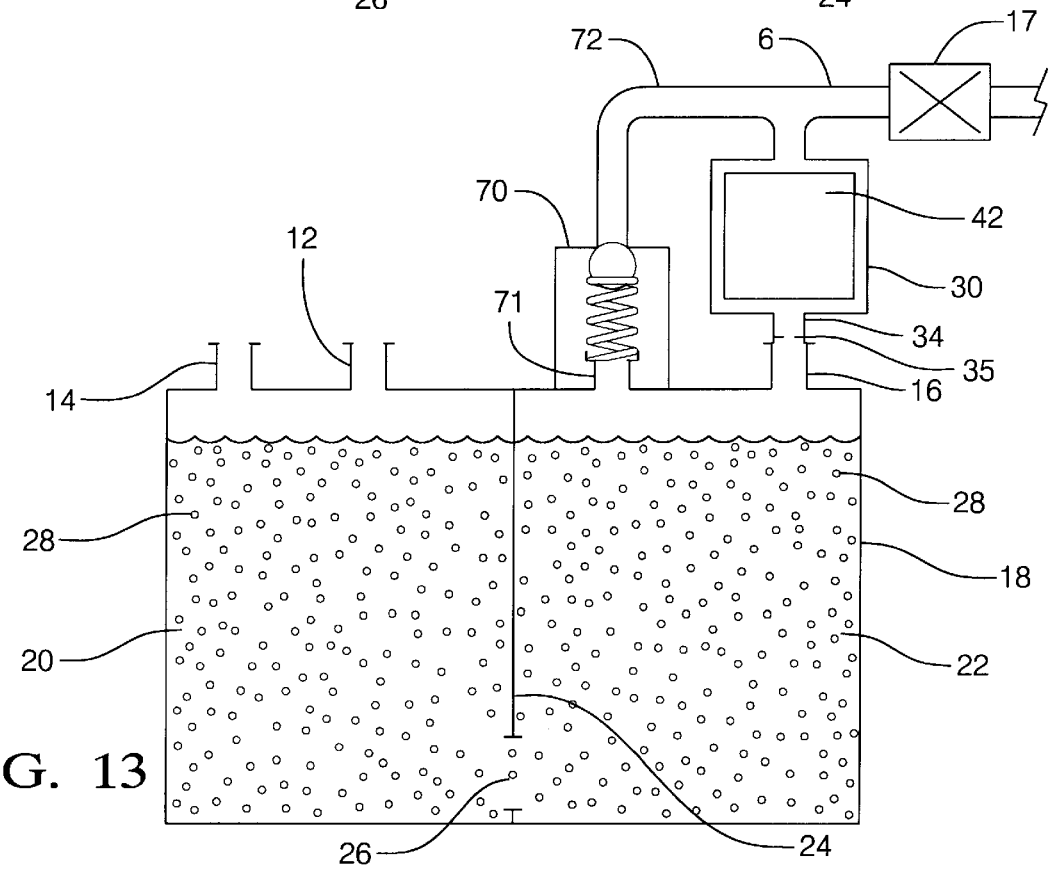
FIG. 13 is a cross-sectional view of another embodiment of the invention showing a purge-bypass valve deployed to reduce contamination of the auxiliary canister during the purge cycle.

FIG. 13 shows an optional purge-bypass valve 70 added to the embodiment shown in FIG. 10. The canister 10 of FIG. 10 is also modified to include a second bypass port 71. Preferably, the flow restrictor 35 is provided within either the first flow passage 34 of canister 30 or the vent port 16 of canister 10. The bypass port 71 communicates with second compartment 22 preferably to the left of vent port 16, as viewed from the perspective of FIG. 13. The bypass valve 70 is connected at one end to bypass port 71 and at its other end via bypass line 72 to the vent line 6 leading to vent valve 17.

The bypass valve 70 is normally closed, opening only when a slight negative pressure exists within the second compartment 22 of canister 10. As soon as the pressure in the second compartment 22 falls below a preset threshold relative to atmospheric pressure, the bypass valve 70 opens and thereby reduces the volume of purge air passing through the auxiliary canister 30. The restrictor 35 also contributes in that regard. Together, their main function is to reduce the degree to which the sorbent material 46 in canister 30 will be contaminated with. particulates and other outside matter drawn in from the atmosphere. This arrangement may be used to make it unnecessary to supply electrical power to auxiliary canister 30 during the entire time the engine of the vehicle is running.

Figure 14:
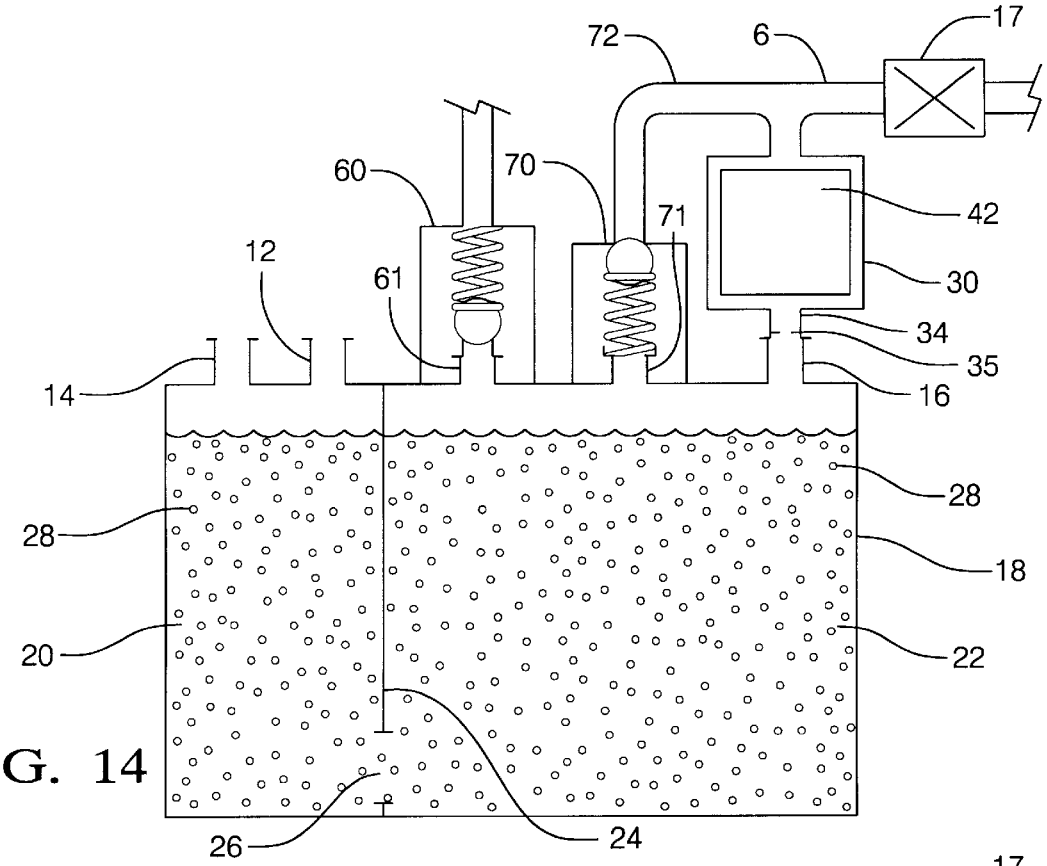
FIG. 14 is a cross-sectional view of another embodiment in which both the refuel-bypass valve and the purge-bypass valve protect the auxiliary canister from contamination during both the purge cycle and refueling.

FIG. 14 illustrates an embodiment in which both the refuel-bypass and purge-bypass valves 60 and 70 are added to the invention shown in FIG. 10. The restrictor 35 is also featured. Bypass valve 60 is connected at one end to the bypass port 61 and at its other end to atmosphere. Bypass valve 70 is connected at one end to bypass port 71 and at its other end via bypass line 72 to the vent line 6 into vent valve 17. This alternative embodiment protects the auxiliary canister 30 from contamination during refueling and the purge cycle.

Figure 15:
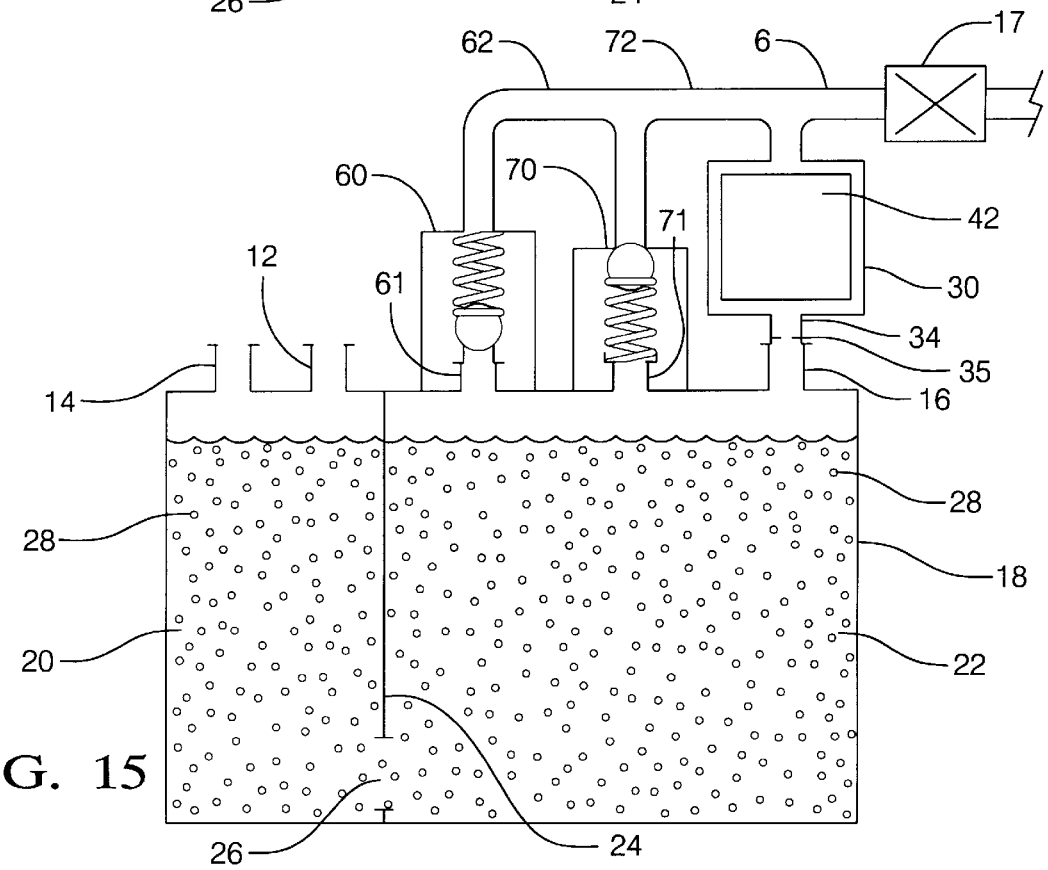
FIG. 15 is a cross-sectional view of another embodiment in which the refuel-bypass and purge-bypass valves are deployed to protect the auxiliary canister from contamination during both refueling and the purge cycle and to simplify leak testing.

FIG. 15 illustrates a variation on the embodiment shown in FIG. 14. In this case, however, the outlet of both bypass valves 60 and 70 are connected via passage 62 and line 72 to the vent line 6. This embodiment not only protects the auxiliary canister 30 from contamination during the purge cycle and refueling but also simplifies testing the system for leaks.

The preferred and alternative embodiments for carrying out the invention have been set forth in detail above according to the Patent Act. Persons of ordinary skill in the art to which this invention pertains may nevertheless recognize that the invention may be modified and/or adapted in various ways without departing from the spirit and scope of the following claims. Persons of such skill will also recognize that the foregoing description is merely illustrative and not intended to limit any of the claims to any particular narrow interpretation.

We claim:

1. An evaporative emissions control system for reducing the amount of fuel vapor emitted from a vehicle, said vehicle having an engine with an intake passage and a fuel system, said control system comprising:

(a) a primary canister having a purge port, a tank port and a vent port in communication with a first sorbent material disposed within said primary canister, said purge port for communicating with said intake passage via a purge valve, said tank port for conveying a mixture of air and said fuel vapor between said fuel system and said primary canister; and (b) an auxiliary canister having a first flow passage and a second flow passage in communication with a second sorbent material disposed within said auxiliary canister, said auxiliary canister being connected (i) via said first flow passage to said vent port of said primary canister and (ii) via said second flow passage and a vent valve connected thereto to atmosphere, said auxiliary canister having an electrical connector and containing a heater connected thereto to which electrical power is conveyed from said vehicle during at least one predetermined time interval to heat said second sorbent material when said control system is operated in a regenerative phase of operation; such that said control system:

(A) during a storage phase of operation, allows flow of said mixture from said fuel system through said tank port into said primary canister wherein said first sorbent material adsorbs a first percentage of said fuel vapor then through said vent port and said first flow passage into said auxiliary canister wherein said second sorbent material adsorbs a second percentage of said fuel vapor then through said second flow passage and said vent valve to atmosphere, and (B) during said regenerative phase, allows air drawn in from atmosphere to flow through said vent valve and said second flow passage into said auxiliary canister to desorb said fuel vapor from said second sorbent material, particularly when heated during said predetermined time interval, with said mixture then being drawn through said first flow passage and said vent port into said primary canister to desorb said fuel vapor from said first sorbent material with said mixture then being drawn out through said purge port into said intake passage by and for combustion within said engine.

2. The evaporative emissions control system claimed in claim 1 wherein said second sorbent material has a mase substantially less than and sorbent properties superior to those of said first sorbent material.

3. The evaporative emissions control system claimed in claim 2 wherein said second sorbent material has a mass equal to less than ten percent of said first sorbent material.

4. The evaporative emissions control system claimed in claim 3 wherein said second sorbent material has a mass equal to less than one percent of said first sorbent material.

5. The evaporative emissions control system claimed in claim 2 wherein said second sorbent material is an adsorbent material.

6. The evaporative emissions control system claimed in claim 5 wherein said adsorbent material is activated carbon.

7. The evaporative emissions control system claimed in claim 6 wherein said activated carbon has a high surface area and a low density.

8. The evaporative emissions control system claimed in claim 6 wherein said activated carbon is formed as at least one thin layer in thermal contact with said heater.

9. The evaporative emissions control system claimed in claim 8 wherein said at least one thin layer consists of granules of activated carbon cemented to said heater.

10. The evaporative emissions control system claimed in claim 8 wherein said heater is formed as a hollow cylinder, and said at least one thin layer is disposed on at least one of an inner surface and an outer surface of said hollow cylinder.

11. The evaporative emissions control system claimed in claim 8 wherein said heater is formed as a honeycomb and said activated carbon is disposed on a plurality of surfaces of said honeycomb.

12. The evaporative emissions control system claimed in claim 8 wherein said heater is made of an electrically conducting ceramic.

13. The evaporative emissions control system claimed in claim 8 wherein said heater comprises a resistor from which at least one fin projects, with said at least one thin layer disposed on said at least one fin.

14. The evaporative emissions control system claimed in claim 1 wherein said second sorbent material is more difficult to desorb than said first sorbent material.

15. The evaporative emissions control system claimed in claim 1 wherein said heater supplies heat to said second sorbent material during said predetermined time interval by heating said second sorbent material by convection.

16. The evaporative emissions control system claimed in claim 1 further including:

(a) a first bypass port incorporated into said primary canister in communication with said first sorbent material;

(b) a refuel-bypass valve connected between said first bypass port and one of atmosphere and said second flow passage; and (c) a flow restrictor incorporated within one of said first flow passage and said vent port; so that when pressure in said primary canister rises above a set threshold during refueling said refuel-bypass valve opens thereby allowing said mixture to flow from said primary canister primarily through said first bypass port to said one of atmosphere and said second flow passage and thus largely bypass said auxiliary canister thereby reducing the degree to which said second sorbent material is contaminated during refueling.

17. The evaporative emissions control system claimed in be claim 16 further including:

(a) a second bypass port incorporated into said primary canister in communication with said first sorbent material; and (b) a purge-bypass valve connected between said second bypass port and said second flow passage; so that when pressure in said primary canister falls below a preset threshold said purge-bypass valve opens thereby allowing air from said vent valve to flow primarily through said second bypass port into said primary canister and thus largely bypass said auxiliary canister thereby reducing the degree to which said second. sorbent material is contaminated.

18. The evaporative emissions control system claimed in claim 1 further including:

(a) a second bypass port incorporated into said primary canister in communication with said first sorbent material;

(b) a purge-bypass valve connected between said second bypass port and said second flow passage; and (c) a flow restrictor incorporated within one of said first flow passage and said vent port; so that when pressure in said primary canister falls below a preset threshold said purge-bypass valve opens thereby allowing air from said vent valve to flow primarily through said second bypass port into said primary canister and thus largely bypass said auxiliary canister thereby reducing the degree to which said second sorbent material is contaminated.

19. The evaporative emissions control system claimed in claim 1 wherein said primary canister comprises a first compartment, a second compartment and an intercompartmental flow passage therebetween; said purge port and said vent port each communicating with said first compartment and said vent port communicating with said second compartment.

20. An auxiliary canister for use with a storage canister of an evaporative emissions control system to aid in reducing the amount of fuel vapor emitted from a vehicle, said storage canister having a vent port in communication with a first sorbent material housed in said storage canister; said auxiliary canister comprising:

(a) an enclosure;

(b) a second sorbent material disposed within said enclosure;

(c) a first flow passage at one end attached to a bottom of said enclosure and at another end for connecting to said vent port and thereby allowing flow between said storage canister and said auxiliary canister;

(d) a second flow passage at one end attached to a top of said enclosure and at another end for connecting to a vent valve of said control system and thereby allowing flow between said auxiliary canister and said vent valve;

(e) a heater in thermal contact with said second sorbent material; and (f) an electrical connector incorporated into said enclosure for conveying electrical power from said vehicle to said heater to warm said second sorbent material.

21. The auxiliary canister claimed in claim 20 wherein said second sorbent material has a mass substantially less than and sorbent properties superior to those of said first sorbent material.

22. The auxiliary canister claimed in claim 21 wherein said second sorbent material has a mass equal to less than ten percent of said first sorbent material.

23. The auxiliary canister claimed in claim 22 wherein said second sorbent material has a mass equal to less than one percent of said first sorbent material.

24. The auxiliary canister claimed in claim 21 wherein said second sorbent material is an adsorbent material.

25. The auxiliary canister claimed in claim 24 wherein said adsorbent material is activated carbon.

26. The auxiliary canister claimed in claim 25 wherein said activated carbon has a high surface area and a low density.

27. The auxiliary canister claimed in claim 25 wherein said activated carbon is formed as at least one thin layer in thermal contact with said heater.

28. The auxiliary canister claimed in claim 27 wherein said at least one thin layer consists of granules of activated carbon cemented to said heater.

29. The auxiliary canister claimed in claim 27 wherein said heater is formed as a hollow cylinder, and said at least one thin layer is disposed on at least one of an inner surface and an outer surface of said hollow cylinder.

30. The auxiliary canister claimed in claim 27 wherein said heater is formed as a honeycomb and said activated carbon is disposed on a plurality of surfaces of said honeycomb.

31. The auxiliary canister claimed in claim 27 wherein said heater is made of an electrically conducting ceramic.

32. The auxiliary canister claimed in claim 27 wherein said heater comprises a resistor from which at least one fin projects, with said at least one thin layer disposed on said at least one fin.

33. The auxiliary canister claimed in claim 20 wherein said second sorbent material is more difficult to desorb than said first sorbent material.

34. The auxiliary canister claimed in claim 20 wherein said heater supplies heat to said second sorbent material by heating said second sorbent material by convection.

* * * * *